US007257928B2

(12) United States Patent
Glöckl

(10) Patent No.: US 7,257,928 B2
(45) Date of Patent: Aug. 21, 2007

(54) FLOOR CONSTRUCTION

(76) Inventor: Josef Glöckl, Ammerseestrasse 6, Kirchheim (DE) 85551

( * ) Notice: Subject to any disclaimer, the term of this patent is extended or adjusted under 35 U.S.C. 154(b) by 364 days.

(21) Appl. No.: 10/723,223

(22) Filed: Nov. 25, 2003

(65) Prior Publication Data

US 2004/0107659 A1 Jun. 10, 2004

(30) Foreign Application Priority Data

Nov. 27, 2002 (DE) ..... 102 55 379

(51) Int. Cl.
*E04F 13/00* (2006.01)

(52) U.S. Cl. ..... 52/311.1; 52/1

(58) Field of Classification Search ..... 52/311.1, 52/64, 177, 174, 1; 446/69; 116/205; 404/6
See application file for complete search history.

(56) References Cited

U.S. PATENT DOCUMENTS

| | | | | |
|---|---|---|---|---|
| 2,999,431 | A * | 9/1961 | Mitchell | 472/92 |
| 4,948,116 | A * | 8/1990 | Vaux | 472/92 |
| 5,303,669 | A * | 4/1994 | Szekely | 116/205 |
| 5,490,821 | A | 2/1996 | Wu | |

FOREIGN PATENT DOCUMENTS

| | | |
|---|---|---|
| DE | 1 052 634 | 3/1959 |
| DE | 40 21 958 | 4/1992 |
| DE | 100 55 352 | 5/2001 |
| EP | 1 219 745 | 7/2002 |
| JP | 4-213602 | 4/1992 |
| JP | 10-165476 | 6/1998 |
| JP | 2001-9004 | 1/2001 |
| WO | WO81/02384 | 9/1981 |
| WO | WO 02/30342 | 4/2002 |

* cited by examiner

*Primary Examiner*—Jeanette Chapman
*Assistant Examiner*—Jessica Laux
(74) *Attorney, Agent, or Firm*—Leffert Jay & Polglaze, PA

(57) ABSTRACT

The invention concerns a floor construction comprising a plurality of surface portions (12) which each comprise at least one respective material with possibly different properties, in particular properties in regard to human perception when standing on the surface portions (12), wherein the different surface portions (12) are of such an arrangement and configuration that when moving on the floor construction (10) a continuously changing, unforeseeable sequence of different surface portions (12) has to be unavoidably stepped upon.

18 Claims, 4 Drawing Sheets

FLOOR CONSTRUCTION

Figure 1:
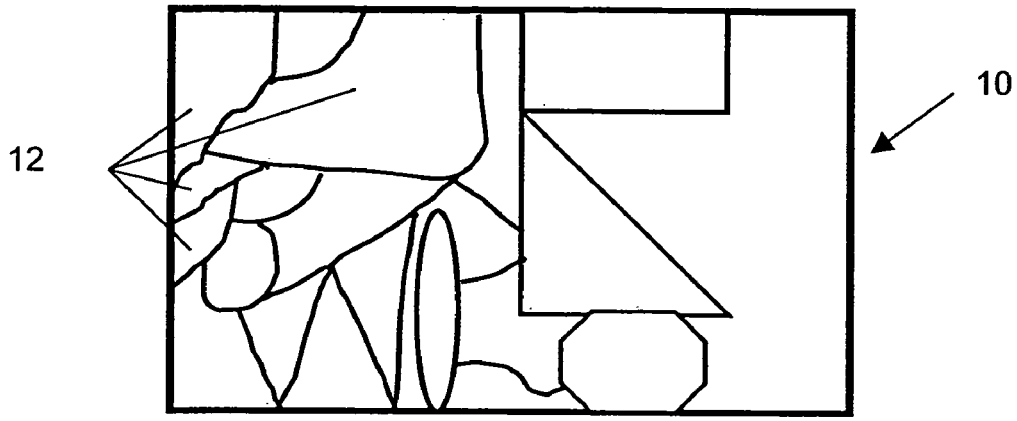

The invention relates to a floor construction or floor coverings which comprise surface portions of different configurations, wherein the surface portions are formed from different materials having different properties.

In this connection German utility model DE 297 10 370 from the state of the art discloses a foot massage mat of rubber or plastic material with many regions of differing massage intensity which is used as an underfoot support surface for promoting the circulation of blood in the feet.

In the sector relating to the surface configuration of sports fields and the like EP 1 124 010 A1 discloses ground damping elements comprising individual reinforced concrete panels.

DE 40 21 958 C2 discloses a floor covering construction which serves as an aid for orientation and permits in particular blind people and visually impaired people to gain their orientation insofar as, when negotiating for example a sidewalk or a roadway, the boundaries thereof can be recognized by the tactilely perceptible differences in the ground covering. The aim of that specification however is in a completely different direction, more specifically to provide that it is precisely an orientation effect, that is to say a comprehensible sequence of different ground coverings, that serves as a recognition pattern.

The present invention aims in the opposite direction, to the effect of so designing buildings of any kind in the public and private sectors, but predominantly offices, but also outside areas in the open air (for example sidewalks), that when people walk thereon and move around in those rooms as many senses as possible are addressed and different pressure sensations are perceived at the soles of the feet so that the person walking on the surface is confronted with fluctuating and unpredictable sensation or sense stimuli so that preferably proprioceptive capabilities are improved.

That object is attained in that the floor construction is so designed that the person when moving around on that floor construction is confronted with a fluctuating sequence, which the person cannot foresee, of differing surface portions which cause different perceptions preferably in the form of proprioceptive action mechanisms, in accordance with the model of the floor of a forest.

The differing configuration of the surface portions can also provide that they are not visible to the user and the floor is perceived by the user as an ordinary continuous unit and the differing configuration relies on non-visible and only feelable properties of the surface material, for example differing degrees of hardness and inclusions which are arranged in concealed relationship and which are round, angular, inclined or regular or irregular in shape and which, when a person walks thereon, cause differing perceptions, preferably in the form of proprioceptive action mechanisms, similarly to those involved when walking on the floor of a forest with uneven, hard and soft, springy and firm regions which require continuously fluctuating muscle tone.

Advantageously the surface portions comprise differing materials which in turn have differing properties.

As already indicated above the surface portions can be such that it appears to the user as though it involves a surface which looks homogeneous from the outside (for example foam, rubber, other) which contains the most widely varying inclusions with other material properties.

Properties relate here in particular to inclusions of differing density, firmness, elasticity, hardness etc. or the surface roughness, surface structure and viscosity or elasticity of the material. The materials used are loose material, for example sand or gravel of differing grain sizes, gel-like material, material in bristle form but also sprayed material.

The surface can be knobbly, channelled, wavy, smooth, rough or with inclinedly rising, irregular grooves which are pronounced to differing levels, etc.

So that the different materials cannot move or mix within the floor covering, they can also be cast into differing materials, for example rubber, foam etc. (then the surface portions comprise the same base material and differ only by virtue of differing inclusions), or there are provided sealing elements or sealing means which hold the respective materials in the surface portion associated therewith.

In addition the sealing means are so designed that they prevent the loose materials from escaping from the floor construction, for example by the floor construction being at least partially covered upwardly by a sheet-like cover material. The cover material can comprise an easily deformable fabric in the manner of a thin carpet, a tear-resistant microfibre or a non-woven surface. However it should be of such a strength that, when passing over the surface with a barrow, the wheels thereof do not ruck up folds.

In a particularly advantageous embodiment of the invention, it is provided that the floor construction is of a mat-like nature or has a load-bearing sub-construction, on which is supported an upper construction which in turn carries the different materials. In that case the entire floor construction is so selected that it can be rolled up in the manner of a roll of carpet and in use needs to be easily unrolled on to the existing conventional floor covering. That affords simple, quick and inexpensive handling of the floor construction according to the invention. It is essential in that respect that the upper construction which for example comprises foam with inclusions of brick or stone, gravel or plastic elements, does not rest directly on the floor but on the sub-construction which comprises a carrier material such as an EPP (expanded polypropylene) panel or felt, sisal, jute, hemp or cork fibre. That prolongs the durability of the floor construction.

As the invention basically pursues the aim of enhancing the perceptions of the person, it is provided that the materials and/or the materials of the floor construction are such that they not only present differences in terms of their tactile sense stimuli but in addition also in respect of temperature sensation, in respect of the sense of balance, an acoustic and a visual perception. That is attained in accordance with the invention in that, in the corresponding surface portions, there are provided further elements which, when a person walks on the respective surface portion, produce stimulation of the above-indicated senses.

In regard to temperature sensation, that is achieved by floor heating or floor cooling at least partially laid therein. The heating or cooling elements incorporated in that way also serve to influence the hardness and elasticity of the corresponding zone. The foam TEMPUR® for example reacts to heat and cold in an extremely differing manner. It becomes very hard when cold and rapidly becomes quite soft when hot. Otherwise the elements are so designed that, when a person walks on the respective surface portion, they additionally trigger off a visual and/or an acoustic signal, which provides that, when the person in question moves in rooms equipped in that way, differing areas of the brain of the person are activated and they receive differing afferent nerve impulses. That in turn results in an increased level of brain activity over all and in particular balanced activity between the neuronal areas in the right and left hemispheres.

A particular advantage of the invention is accordingly in the medical area of proprioception as a sub-area of sensor motor activity and constantly confronts the person in the room equipped in accordance with the invention with new, fluctuating and in particular unexpected stimuli which are perceived directly or indirectly by way of the soles of the feet.

In an advantageous embodiment the surface portions are formed irregularly in respect of their shape and their size, thus affording an overall mosaic-like pattern.

The materials have different coefficients of elasticity (foam rubber with a high level of elasticity and for example stone with a very low level of elasticity) or comprise loose material of differing grain sizes which yields to the pressure of the foot when a person walks thereon. The same effect can be achieved by surface portions of a cushion-like nature, which are filled with different gel-like substances and also achieve different perception for the foot. Accordingly the following can be used as the materials involved: stone, gel, plastic material, garden hose, pointed and round elements, elastic elements, elements which are straight and round, angled, curved in three dimensions or helical, as well as all other conceivable forms and materials of different properties.

In a further embodiment of the invention the sub-construction has mounting elements which project out of the plane of the sub-construction and which for example comprise a rod-shaped element of differing section (round material or square material) or hemispheres which are let into the sub-construction and which in turn are so designed that a tilting element arranged on those mounting elements performs a pivotal movement about the mounting element when subjected to an off-centre loading. In that case the mounting elements are so arranged in the sub-construction that the pivotal movement performed by the tilting elements only involves a small angular range so that the sense of balance of the person is admittedly addressed but at the same time 'loosing one's balance' is reliably avoided.

In another embodiment the floor construction according to the invention is in the form of a children's play covering which covers a relatively small area in a room and which results in differing sensory stimulation.

In a first variant the above-described embodiment of the floor construction is of a panel frame-like configuration so that it is also possible to use movable materials such as for example sand or stones for filling the surface portions.

A second variant involves the floor construction being of a mat-like nature so that when not in use it can be rolled up to save space and is only laid on the existing floor covering when in use. Here in particular spray materials which preferably have a relief-like surface structure are used for the surface portions of differing configurations. A panel of carrier material, for example an EPP-panel, carries a foam mat into which other materials are cast.

In order to avoid soiling due to the floor construction, in particular due to materials escaping, the floor construction is at least partially enclosed by a cover material in the form of a flexible fabric or a sheet or foil, preferably a sheet or foil which can be washed off and which is easy to clean and which does not interfere with the perception of the differing materials.

Alternatively another structure is also possible: instead of arranging the foam with inclusions on the lower carrier panel and then arranging the cover material, it is also possible to adopt as the lowermost layer the foam on which the carrier mat and the cover material are then arranged.

The cover layer can also be in the form of a peripherally closed casing which encloses the carrier mat and the foam and which can be opened for example by a zip fastener or a loop-and-hook (touch-and-close) fastener in order to change the covering or the panels.

The invention further concerns a process for the production of one of the above-stated floor constructions, wherein the division and/or the shape and sizing of the individual surface portions is effected in accordance with given, room-related criteria and/or is effected by means of a random generator.

Room-related criteria are here inter alia: the size of the room, the natural or artificial lighting conditions, a colour configuration, favoured movement areas ('walking wear lines') or for example transitional regions leading into other rooms.

The process preferably provides that cast into a carrier material (for example into a mat of foam, rubber or TEMPUR®) are different elements (uneven, arbitrarily shaped elements which afford a different sense stimulation when a person walks thereon).

A further possibility of giving rise to the tactile stimuli which the user cannot foresee involves incorporating into the mat a hose system with differing reservoirs, in which fluid of any consistency and viscosity flows. When a user treads on a location on that communicating hose system it yields as the fluid is distributed into other regions. If a second or third user also treads at another location on a part of the communicating hose system, the first user feels a reaction on the part of the floor beneath him, he has to proprioceptively react thereto and thus promotes the sensor-motor perception capability and reaction of his body. The principle is comparable to that of communicating vessels or that of a water bed.

Figure 2:
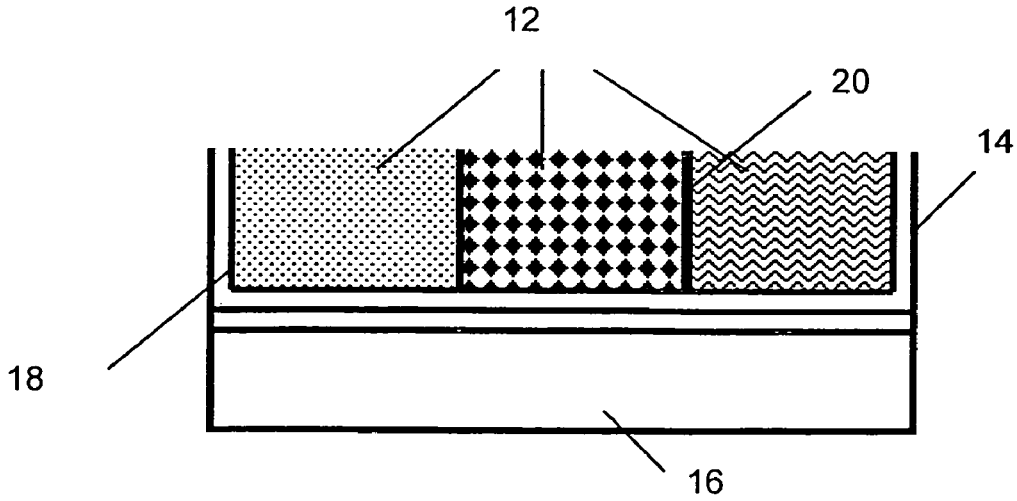
Figure 3:
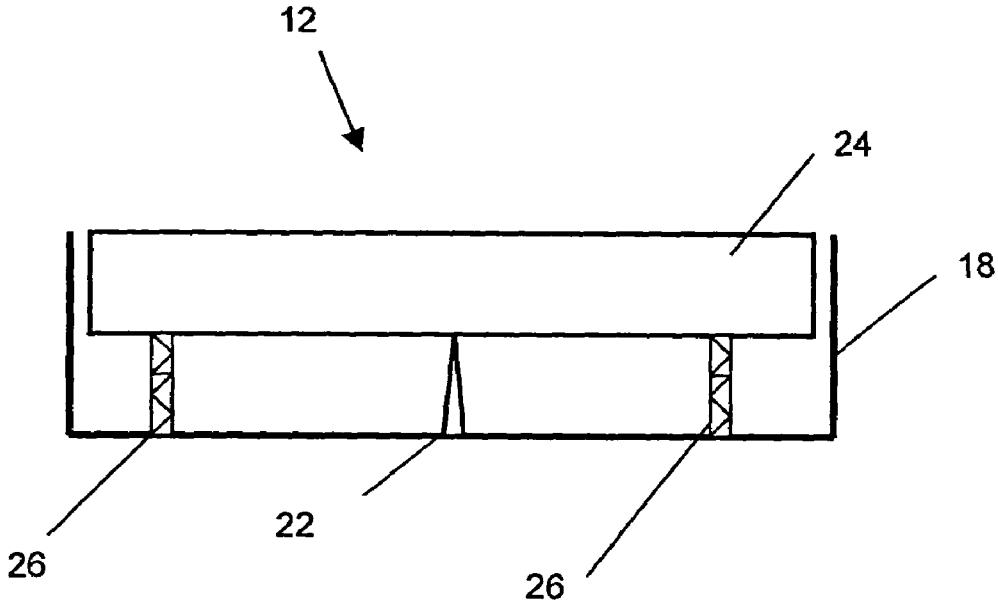
Figure 4:
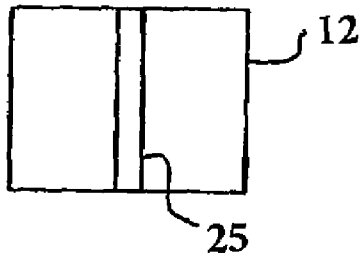
Figure 4:
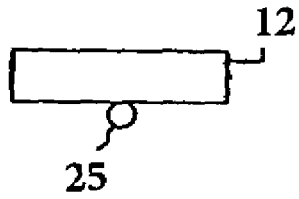
Figure 4:
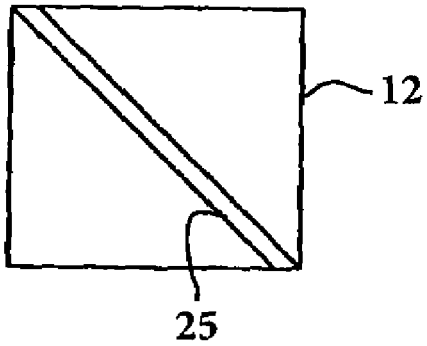
Figure 5:
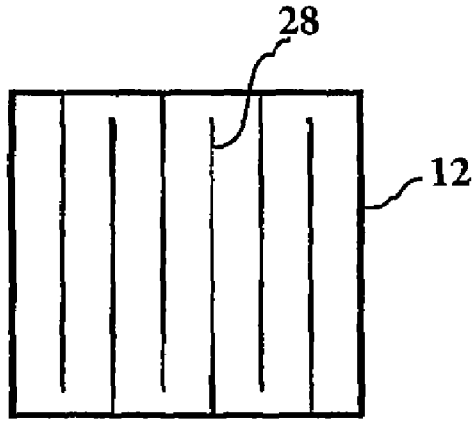

Further advantages, embodiments and details in relation to the described embodiments are set forth in the specific description hereinafter in which:

FIG. 1 shows a plan view of a floor construction according to the invention, FIG. 2 shows a view in cross-section through the floor construction according to the invention with differing materials indicated, FIG. 3 shows a view in cross-section through an alternative embodiment of the invention, FIGS. 4*a-c* show further embodiments for a configuration of surface portions, FIG. 5 shows an embodiment with a hose arrangement in loop lines, and FIG. 6*a* shows a closely related embodiment with an arrangement of small bar portions of differing stiffness.

FIG. 1 shows the basic configuration of the floor construction according to the invention which is generally identified by 10 and which comprises a plurality of surface portions 12 which in turn are supported in an upper construction 14. The upper construction 14 is carried by a sub-construction 16 which in an embodiment of the invention is a flexible rollable mat. In alternative embodiments this involves a fixed, frame-like construction.

The upper construction 14 can additionally include receiving devices 18 which are suitable for receiving the corresponding surface portions 12 and which hold then stationary in their position in the upper construction. The receiving devices 18 are of a configuration which is tray-like or approximately rectangular in cross-section in order laterally to delimit the surface portions 12.

The upper construction 14 further includes sealing means 20 which provide a transition which is as uniform as possible between the respective surface portions 12, thereby avoiding edges when making the transition from one surface portion 12 to another. Preferably those sealing means are formed from a rubber-like material, of selectively softer or harder firmness.

In an advantageous embodiment of the invention the upper construction 14 is, at least in a region-wise manner, such that it is suitable for carrying a receiving device 18. As shown in FIGS. 3 and 4, the receiving device 18 includes mounting elements 22 and a tilting element 24 which is supported pivotably on the mounting element 22. In this arrangement the mounting element 22 and the tilting element 24 are so arranged that, in the passive condition, that is to say in a condition in which no one is standing on the surface element or surface portion 12, the tilting element 24 is oriented as horizontally as possible and thus the surface thereof is approximately coincident with the surface of the surrounding surface portions 12 or sealing elements 20 respectively. When a person stands on the respective surface portion 12, that is to say in the active condition, the tilting element 24 pivots about the mounting element 22, due to the off-centre loading thereon, thus affording a slightly inclined surface which causes the person to perform a slight balancing motion and thus activates the organ of balance.

In order to provide a surface which is as homogeneous as possible over the large number of surface portions 12 without steps occurring in the form of inclined or slanting mounting elements 22, it is provided that the receiving device 18 additionally includes spring elements 26 which are arranged between the receiving device 18 and the tilting element 24 and which are so set that, in the rest condition, they hold the tilting element 24 in an approximately horizontal position on the mounting element 22.

The spring elements can be any suitable return elements, for example foam layers, return-flowing fluids, elastomeric particles and so forth.

In an alternative configuration of the invention the floor construction 10 only includes a sub-construction 16, on which the different surface portions 12 are arranged directly. This embodiment is characterized in particular by ease and low cost of manufacture. In this case, the sub-construction 16 is in the form of a mesh or a mat which can be laid out and which at the top side has such materials which are to be easily fastened on the floor construction 10, in particular by injection moulding or by adhesive means. In this case the material can produce different surface portions 12 insofar as it has a different surface structure, for example by virtue of surface grooving, surface tilting, a relief-like configuration for-the surface or by the formation of openings or recesses in the material. Preferably disposed on a carrier mat of EPP is a foam layer with plastic inclusions, which is covered by a cover layer.

In a further advantageous configuration of the invention the floor construction 10 according to the invention is so designed that the individual surface portions 12 have a closed hollow internal space which is filled with a substance. That substance is preferably an oil or another filling agent which, in the case of different physical conditions, also involves a differing viscosity. Therefore the oil-filled surface portion 12 is further so designed that for example it is possible to apply an electrical voltage or to alter the temperature of the substance (for example by heating or cooling elements). The mode of operation of the floor construction 10 according to the invention, in this embodiment, is now as follows:

Upon the application of an electrical voltage or upon a change in temperature the viscosity of the filling agent or the substance disposed in the internal space also changes so that overall the hardness and/or toughness of the floor construction can be dynamically and adaptively controlled. This floor construction 10 which is preferably in the form of a mat, besides the internal spaces filled with the oil-like substance, further includes suitable electrical connections in order to be able to alter the physical control parameters. Instead of the internal spaces filled with a substance, it is also possible to use a plastic material which changes its tactilely perceptible viscosity if a physical control parameter which acts thereon changes. The control parameter can be inter alia the locally acting pressure and thus the speed of the person who is walking on the floor construction.

In a further embodiment illustrated in FIG. 5, provided in the individual surface portions is an arrangement comprising conductingly connected vessels 28. This can involve a hose 25 filled with a fluid (see FIG. 4*a*) which is arranged in predetermined loop lines in the upper construction. The stiffness and the degree of filling of the hose are so set that a movement occurs, in a comparable fashion to a water bed. Disposed on such a hose bundle is a suitable tread layer which transmits to the foot, local compression of the hose as the information 'yielding substrate'.

In a closely related embodiment arranged in the upper construction is a fluid-tight deformable container, for example of plastic material, with a fluid of predetermined viscosity. Fitted in the deformable container is a mesh or latticework which opposes a predetermined level of resistance to escape of fluid when a person stands thereon.

Figure 6:
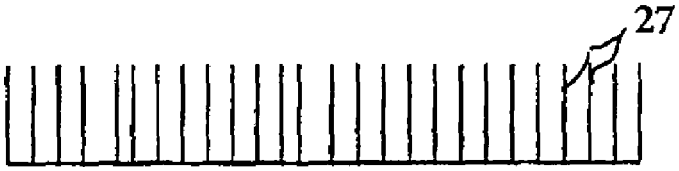

In a closely related embodiment as shown in FIG. 6 the individual surface portions comprise bar portions 27 which are disposed substantially upright in closely mutually juxtaposed relationship, wherein such bar portions of equal stiffness can be combined together in groups. That arrangement affords a differing profile in respect of height over the surface portion.

The invention is not limited in its implementation to the preferred embodiments set forth hereinbefore. On the contrary, it is possible to envisage a number of alternative configurations which make use of the illustrated solution in constructions which are of a basically different nature.

What is claimed is:

1. A floor construction comprising:

a plurality of elements, each element having an external surface and an interior, at least three of the plurality of elements having different interior properties from each other so that each of the at least three elements imparts a different sensory stimuli to a sole of a user's foot when the user steps on the external surface of that element;

wherein the floor construction is formed as a continuous unit with an externally homogeneous looking surface, wherein the differing interior properties of the at least three elements are concealed from view; and wherein the at least three elements having different interior properties from each other are each formed from the same material, but have different inclusions cast therein.

2. The floor construction according to claim 1, further comprising an upper construction that contains the plurality of elements and is supported by a sub-construction.

3. The floor construction according to claim 2, wherein the sub-construction is a flexible material.

4. The floor construction according to claim 1, wherein the floor construction can be used in at least one of inside and outside spaces.

5. The floor construction according to claim 1, wherein the floor construction is suitable for laying on conventional floor coverings.

6. A floor construction comprising:

a plurality of elements, each element having an external surface and an interior, at least three of the plurality of elements having different interior properties from each other so that each of the at least three elements imparts a different sensory stimuli to a sole of a user's foot when the user steps on the external surface of that element;

wherein the floor construction is formed as a continuous unit with an externally homogeneous looking surface, wherein the differing interior properties of the at least three elements are concealed from view: and wherein the at least three elements having different interior properties from each other differ from each other in respect to at least one of shape and size.

7. The floor construction according to claim 6, wherein the at least three elements having different interior properties from each other are separated from each other by other elements of the plurality of elements.

8. The floor construction according to claim 6, wherein the interior properties comprise a degree of hardness or at least one of a hardness and a viscosity, or at least one of elasticity and a surface temperature of the material.

9. The floor construction according to claim 6, wherein the floor construction is enclosed by a cover material and wherein the different interior properties are provided by at least one of a solid material, a loose material, materials having different grain size, gel-like materials, and bristle materials.

10. The floor construction according to claim 9, wherein a transition between different elements of the at least three elements having different properties from each other is effected in an edge-free manner.

11. The floor construction according to claim 6, wherein the at least three elements having different properties from each other further comprise a closed internal space filled with a liquid substance, wherein the substance changes viscosity when an electrical voltage is applied thereto or when the substance changes temperature.

12. The floor construction according to claim 11, wherein the liquid substance is oil like.

13. The floor construction according to claim 6, wherein each of the at least three elements having different properties from each other further comprises a closed internal space, the internal spaces of the respective at least three elements having different properties from each other connected in a mutually communicative relationship and filled with a material of a predetermined viscosity or toughness.

14. The floor construction according to claim 6, wherein the surface has a homogeneous looking surface roughness or surface structure.

15. A floor construction comprising:

a plurality of elements, each element having an external surface and an interior, at least three of the plurality of elements having different interior properties from each other so that each of the at least three elements imparts a different sensory stimuli to a sole of a user's foot when the user steps on the external surface of that element;

wherein the floor construction is formed as a continuous unit with an externally homogeneous looking surface, wherein the differing interior properties of the at least three elements are concealed from view; and wherein one or more elements of the at least three elements having different properties from each other comprises tilting elements and the tilting elements of the one or more elements of the at least three elements having different properties from each other are movably mounted such that when a person steps thereon the one or more elements of the at least three elements having different properties from each other and the tilting elements change position by tilting, pivoting, sliding, or sinking at different speeds.

16. A floor construction comprising:

a plurality of elements, each element having an external surface and an interior, at least three of the plurality of elements having different interior properties from each other so that each of the at least three elements imparts a different sensory stimuli to a sole of a user's foot when the user steps on the external surface of that wherein the floor construction is formed as a continuous unit with an externally homogeneous looking surface, wherein the differing interior properties of the at least three elements are concealed from view; and wherein one or more elements of the at least three surface portions having different properties from each other further comprise a heating or cooling means that heats or cools the one or more surface portions of the at least three elements having different properties from each other.

17. A floor construction comprising:

a plurality of elements, each element having an external surface and an interior, at least three of the plurality of elements having different interior properties from each other so that each of the at least three elements imparts a different sensory stimuli to a sole of a user's foot when the user steps on the external surface of that element; and an upper construction comprised of the plurality of surface portions and is supported by a sub-construction;

wherein the floor construction is formed as a continuous unit with an externally homogeneous looking surface, wherein the differing interior properties of the at least three elements are concealed from view; and wherein the upper construction comprises a foam containing different materials.

18. Use of the floor construction according to claim 1 , 6, 8, 9, 15, 16, 2, 11, 13, or 14 wherein the floor construction is in the form of at least one of a children's play mat and a children's play covering.

* * * * *